US009142126B2

(12) United States Patent
Scoda

(10) Patent No.: US 9,142,126 B2
(45) Date of Patent: Sep. 22, 2015

(54) EMERGENCY TRAFFIC LIGHT SYSTEM

(71) Applicant: Michael Scoda, Morganville, NJ (US)

(72) Inventor: Michael Scoda, Morganville, NJ (US)

( * ) Notice: Subject to any disclaimer, the term of this patent is extended or adjusted under 35 U.S.C. 154(b) by 60 days.

(21) Appl. No.: 14/242,124

(22) Filed: Apr. 1, 2014

(65) Prior Publication Data

US 2014/0292540 A1 Oct. 2, 2014

Related U.S. Application Data

(60) Provisional application No. 61/807,623, filed on Apr. 2, 2013.

(51) Int. Cl.

| | |
|---|---|
| ***G08G 1/00*** | (2006.01) |
| ***G08G 1/07*** | (2006.01) |
| ***G08G 1/04*** | (2006.01) |
| ***G08G 1/097*** | (2006.01) |

(52) U.S. Cl.
CPC .. *G08G 1/07* (2013.01); *G08G 1/04* (2013.01); *G08G 1/097* (2013.01)

(58) Field of Classification Search
CPC ..... G08G 1/007; G08G 1/081; G08G 1/0137; G08G 1/04; G08G 1/087; G08G 1/097; G08G 1/07; G08G 1/0116; G08G 1/0145
See application file for complete search history.

(56) References Cited

U.S. PATENT DOCUMENTS

| | | | | |
|---|---|---|---|---|
| 7,423,551 | B1 * | 9/2008 | Sharrow | 340/908 |
| 2002/0027510 | A1 * | 3/2002 | Jones et al. | 340/907 |
| 2004/0070518 | A1 * | 4/2004 | Whittle et al. | 340/907 |
| 2007/0126599 | A1 * | 6/2007 | Gembala et al. | 340/908 |

* cited by examiner

*Primary Examiner* — Kerri McNally
*Assistant Examiner* — Renee Dorsey

(57) ABSTRACT

An emergency traffic system is provided. The emergency traffic system may include a power source, a battery, an emergency traffic light, a light sensor, a mounting assemblage, a computer and an existing traffic light system. The emergency traffic system may be mounted on a traffic light system, whereby the light sensor may be secured to at least one traffic light thereof. The computer may receive electrical signals from the light sensor so as to learn and record the history of the traffic light patterns of the traffic light system. In the next step, the computer compares the instant traffic light pattern to the history of traffic light patterns during the operation of the traffic light system being monitored. If the instant traffic light pattern is not found in the history, then the computer transmits the on signal to the emergency traffic light. If the instant traffic pattern is found in the history then the computer continues to monitor the step comparison. If the on signal has been transmitted to the emergency traffic light, then the computer continues to look for the return of a signal from the light sensor, it then reacts to traffic light system working again, and then the computer transmits the off signal to the emergency traffic light.

9 Claims, 2 Drawing Sheets

EMERGENCY TRAFFIC LIGHT SYSTEM

CROSS-REFERENCE TO RELATED APPLICATION

This application claims the benefit of priority of U.S. provisional application No. 61807623 filed 2 Apr. 2013 the contents of which are herein incorporated by reference.

BACKGROUND OF THE INVENTION

The present invention relates to traffic control and, more particularly, to a system for managing traffic during a power outage and/or during other emergencies that cause traffic signal failure.

Currently, systems for managing traffic during a power outage and/or during other emergencies that cause traffic signal failure are either fully integrated with the existing traffic system or not present because the full integration systems are prohibitively expensive. In the case of the latter, valuable human resources are diverted from responding to an emergency so that they are may manage traffic.

As can be seen, there is a need for an improvement in traffic light systems in case of emergencies, whereby an inexpensive installation can manage traffic without human intervention.

SUMMARY OF THE INVENTION

In one aspect of the present invention, emergency traffic light system comprises: light sensor coupled to at least one traffic light, wherein the light sensor is configured to transmit a plurality of electrical signals representative of the frequency of the light emission from the at least one traffic light; a computer configured to determine an instant traffic light pattern by analyzing the plurality of electrical signals received from the light sensor so as to record a history of the instant traffic light pattern, wherein the computer is configured to compare the instant traffic light pattern to the history of the instant traffic light pattern; and an emergency traffic light mounted to the at least one traffic light, wherein the emergency traffic light is operable by the computer.

In another aspect of the present invention, a method of managing traffic during a power outage, comprises: providing an emergency traffic light system comprising: light sensor coupled to at least one traffic light, wherein the light sensor is configured to transmit a plurality of electrical signals representative of the frequency of the light emission from the at least one traffic light; a computer configured to determine an instant traffic light pattern by analyzing the plurality of electrical signals received from the light sensor so as to record a history of the instant traffic light pattern, wherein the computer is configured to compare the instant traffic light pattern to the history of the instant traffic light pattern; and an emergency traffic light mounted to the at least one traffic light, wherein the emergency traffic light is operable by the computer; providing a power source electronically connected to the computer; and programming the computer to operate the emergency traffic light when the instant traffic light pattern does not match the history of the instant traffic light pattern.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an emergency traffic system. The emergency traffic system may include a power source, a battery, an emergency traffic light, a light sensor, a mounting assemblage, a computer and an existing traffic light system. The emergency traffic system may be mounted on a traffic light system, whereby the light sensor may be secured to at least one traffic light thereof. The computer may receive electrical signals from the light sensor so as to learn and record the history of the traffic light patterns of the traffic light system. In the next step, the computer compares the instant traffic light pattern to the history of traffic light patterns during the operation of the traffic light system being monitored. If the instant traffic light pattern is not found in the history, then the computer transmits the on signal to the emergency traffic light. If the instant traffic pattern is found in the history then the computer continues to monitor the step comparison. If the on signal has been transmitted to the emergency traffic light, then the computer continues to look for the return of a signal from the light sensor, it then reacts to traffic light system working again, and then the computer transmits the off signal to the emergency traffic light.

Figure 1:
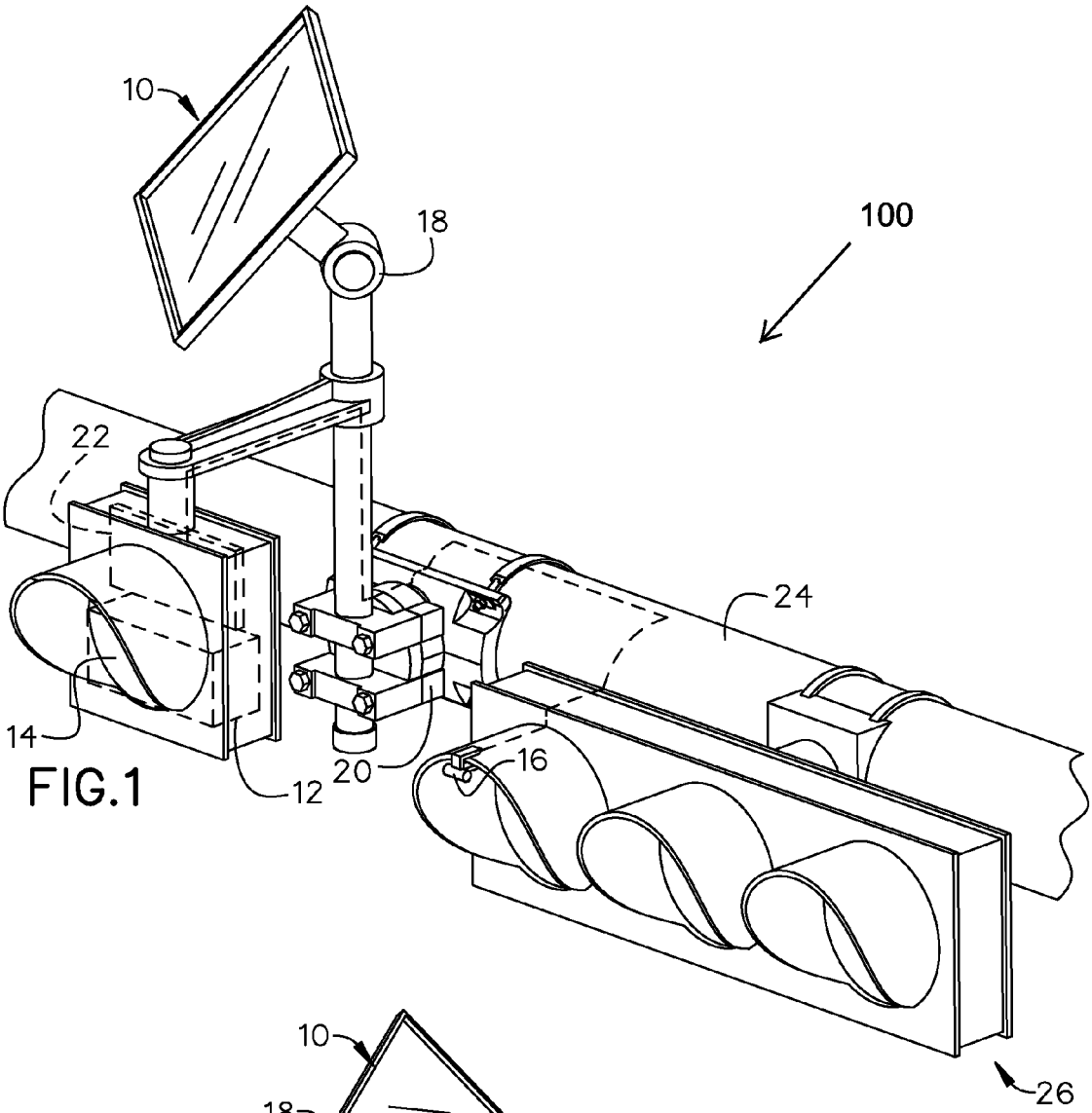
FIG. 1 is a perspective view of an exemplary embodiment of the present invention.
Figure 2:
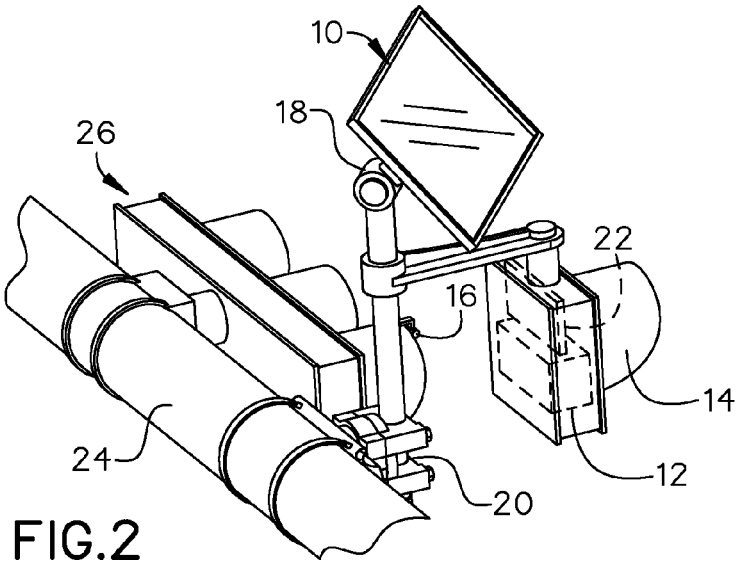
FIG. 2 is a perspective view of an exemplary embodiment of the present invention.

Referring to FIGS. 1 and 2, the present invention may include an emergency traffic system (ETS) 100. The ETS 100 may include a power source 10, a battery 12, an emergency traffic light 14, a light sensor 16, a mounting assemblage 20 and a computer 22.

The mounting assemblage 20 may include apparatus for mounting the ETS 100 to a traffic light system 26 and/or a structure 24 that a traffic light system 26 may be mounted on. The traffic light system 26 may include at least one traffic light configured to control traffic at an intersection. The structure 24 may include poles, wires, or the like.

The power source 10 may include a solar panel and/or any suitable type of photovoltaic panel that may be adjustably mounted to the mounting assemblage 20. The solar panel may include see-through types as well as types with an opaque backing. Generally, any of the commercially available photovoltaic panels may be used. Electrical connections to the photovoltaic elements may be made by a group of conductors extending for example from one predetermined connection point.

An articulating mechanism 18 may adjustably mount the power source 10 to the mounting assemblage 20. The articulating mechanism 18 may include a plurality of pivotably connected arm segments adapted so that the power source 10 may pivot in relation to the mounting assemblage 20 and/or the structure 24.

The power source 10 may be electronically connected to the battery 12, the computer 22 and/or the emergency traffic light 14. The battery 12 may be adapted to operate safely over a wide range of temperatures and provide sufficient energy to the emergency traffic light 14 for up to four consecutive days. The battery 12 may be rechargeable, such as a lithium battery or any of the commercially available rechargeable battery, so that the battery 12 may be recharged by the power source 10.

The emergency traffic light 14 may be electronically connected to the power source 10 and or the computer 22. The emergency traffic light 14 may be remotely operable by the computer. The emergency traffic light 14 may provide at least one predetermined emergency state when receiving an on signal and/or an error condition from the computer 22. The emergency traffic light 14 may cease providing at least one predetermined emergency state when receiving an off signal from the computer 22. The emergency state may include intermittent flashing of a yellow and/or red light, arrows and/or any other lenses as predetermined during traffic analysis. The at least one predetermined emergency state may be reconfigured by the local municipal authority. The reconfiguration of the emergency traffic light 14 may be done remotely.

The power source 10 may be electronically connected to the computer 22. The computer 22 may include at least one processing element and some form of memory. The computer 22 may include a program product including a machine-readable program code for causing, when executed, the computer 22 to perform steps. The program product may include software which may either be loaded onto the computer 22 or accessed by the computer 22. The software may be accessed by the computer 22 using a web browser. The computer 22 may access the software via the web browser using the internet, extranet, intranet, host server, internet cloud and the like.

The light sensor 16 may be secured to at least one light of a traffic light system 26 so as to sense the light emitting from the at least one light, as illustrated in FIG. 1. The light sensor 16 may include a photodiode or any commercially available photo-detector capable of converting light into an electrical signal. The light sensor 16 may be adapted to transit a plurality of electrical signals representative of the frequency of the light activity of the at least one light. The light sensor 16 may be electronically connected to the computer 22.

The computer 22 may be adapted to learn and store a history of traffic light patterns. The computer 22 may be adapted to analyze the electrical signals received from the light sensor 16 so as to learn and/or ascertain an instant traffic light pattern. The computer 22 may be adapted to compare the instant traffic light pattern to the history of traffic light pattern learned. The computer 22 may be adapted to transmit the on signal to the emergency traffic light 14 when the instant traffic light pattern deviates from the traffic light pattern history, such as when the at least one traffic light may be interrupted and/or discontinued, for example, during a power outage. In certain embodiments, such discontinuity and/or interruption in the traffic light sequence pattern may trigger the error condition. The computer 22 may be adapted to transmit the off signal to the emergency traffic light 14 when the instant traffic light pattern resumes matching the historical traffic light pattern, for example, when power may be restored after a power outage.

Figure 3:
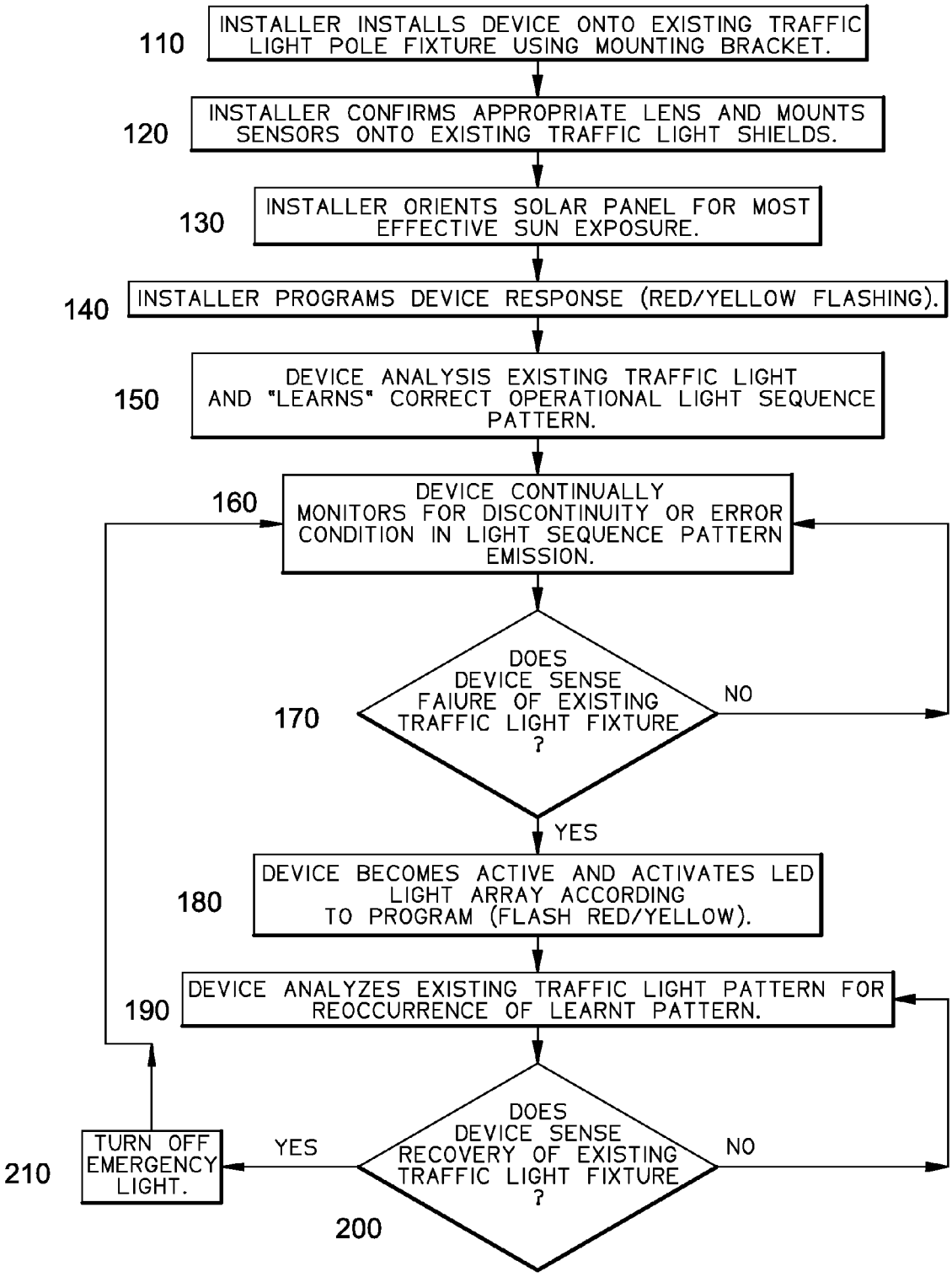
FIG. 3 is a flow chart of an exemplary embodiment of the present invention.

FIG. 3 illustrates the steps performed by the ETS 100 in the management of a traffic light system during a power outage in accordance with an embodiment of the present invention. In step 110, a user installs the ETS 100 onto a traffic light system 26 and/or a structure 24 that the traffic light system 26 may be mounted on by using the mounting assemblage 20. In step 120, the user confirms and couples the appropriate light sensor 16 to at least one light of a traffic light system 26. In step 130, the user may orient the power source 10 by employing the articulating mechanism 18 so as to gather optimal solar exposure throughout the lifespan of the ETS 100. In step 140, the user may program the emergency traffic light 14. In step 150, the computer 22 receives electrical signals from the light sensor 16 so as to learn and record the history of the traffic light patterns of the traffic light system 26. In the next step 160, the computer 22 compares the instant traffic light pattern to the history of traffic light patterns during the operation of the traffic light system 26 being monitored. This history may be embodied in the computer 22 memory throughout operational life and/or received from an external source, such as a municipal authority or the like. In step 170, if the instant traffic light pattern is not found in the history, then the computer 22 transmits the on signal to the emergency traffic light 14 (step 180). If the instant traffic pattern is found in the history then the computer 22 continues to monitor the step 160 comparison (step 170). If step 180 has been taken, then the computer continues to compare the instant traffic light pattern to the history of traffic light patterns (step 200). If step 200 identifies that the instant traffic light pattern matches the history, then the computer 22 transmits the off signal to the emergency traffic light 14 (step 210).

It should be understood, of course, that the foregoing relates to exemplary embodiments of the invention and that modifications may be made without departing from the spirit and scope of the invention as set forth in the following claims.

What is claimed is:

1. An emergency traffic light system comprising:

a light sensor coupled to at least one traffic light, wherein the light sensor is configured to transmit a plurality of electrical signals representative of the frequency of the light emission from the at least one traffic light;

a computer configured to determine an instant traffic light pattern by analyzing the plurality of electrical signals received from the light sensor so as to record a history of the instant traffic light pattern, wherein the computer is configured to compare the instant traffic light pattern to the history of the instant traffic light pattern; and an emergency traffic light mounted to the at least one traffic light, wherein the emergency traffic light is operable by the computer.

2. The emergency traffic light system of claim 1, wherein the at least one traffic light is part of an existing traffic light system.

3. The emergency traffic light system of claim 1, further including a power source electronically connected to a battery, the computer and the emergency traffic light.

4. The emergency traffic light system of claim 3, wherein the power source is a solar panel.

5. The emergency traffic light system of claim 4, further including a mounting assemblage connecting the solar panel to the emergency traffic light system.

6. A method of managing traffic during a power outage, comprising:

providing an emergency traffic light system comprising: light sensor coupled to at least one traffic light, wherein the light sensor is configured to transmit a plurality of electrical signals representative of the frequency of the light emission from the at least one traffic light; a computer configured to determine an instant traffic light pattern by analyzing the plurality of electrical signals received from the light sensor so as to record a history of the instant traffic light pattern, wherein the computer is configured to compare the instant traffic light pattern to the history of the instant traffic light pattern; and an emergency traffic light mounted to the at least one traffic light, wherein the emergency traffic light is operable by the computer;

providing a power source electronically connected to the computer; and programming the computer to operate the emergency traffic light when the instant traffic light pattern does not match the history of the instant traffic light pattern.

7. The method of claim 6, wherein the at least one traffic light is part of an existing traffic light system.

8. The method of claim 6, wherein the history of instant traffic light pattern is received from an external source.

9. A system for managing traffic during a power outage, comprising:

a light sensor coupled to at least one traffic light, wherein the light sensor is configured to transmit a plurality of electrical signals representative of the frequency of the light emission from the at least one traffic light;

a computer;

an emergency traffic light mounted to the at least one traffic light, wherein the emergency traffic light is operable by the computer; and a program product comprising machine-readable program code for causing, when executed, the computer to perform the following process steps:

receiving the plurality of electrical signals from the light sensor;

determining an instant traffic light pattern from the plurality of electrical signals;

producing a history of the instant traffic light pattern from the plurality of electrical signals;

comparing the instant traffic light pattern with the history of the instant traffic light pattern to determine a match;

operating the emergency traffic light when the instant traffic light pattern mismatches with the history of the instant traffic light pattern; and rendering the emergency traffic light temporarily inoperable when the instant traffic light pattern matches with the history of the instant traffic light pattern.

* * * * *